US005775017A

United States Patent [19]

Morrow

[11] Patent Number: 5,775,017

[45] Date of Patent: Jul. 7, 1998

[54] PRODUCT DISPLAY

[75] Inventor: Lester W. Morrow, Chanhassen, Minn.

[73] Assignee: Gage In-Store Marketing, Minneapolis, Minn.

[21] Appl. No.: 600,812

[22] Filed: Feb. 13, 1996

[51] Int. Cl.[6] ..... G09F 3/00

[52] U.S. Cl. ..... 40/642.01; 40/655

[58] Field of Search ..... 40/5, 642.01, 655, 40/657

[56] References Cited

U.S. PATENT DOCUMENTS

| | | | |
|---|---|---|---|
| 1,667,829 | 5/1928 | Strump | 40/655 |
| 1,972,558 | 9/1934 | Hanney | 40/657 |
| 3,016,638 | 1/1962 | Singer | 40/5 |
| 4,286,764 | 9/1981 | Pfeifer | 248/220.3 |
| 4,583,308 | 4/1986 | Taub | 40/642 X |
| 4,646,454 | 3/1987 | Fast | 40/657 X |
| 4,703,570 | 11/1987 | Fast | 40/657 |
| 4,750,698 | 6/1988 | Barnes | 248/220.4 |
| 4,754,563 | 7/1988 | Fast | 40/657 X |
| 4,773,172 | 9/1988 | Fast | 40/657 |
| 4,801,116 | 1/1989 | Blankenship | 248/220.4 |
| 4,821,437 | 4/1989 | Abramson et al. | 40/642 |
| 4,882,868 | 11/1989 | Fast | 40/657 |
| 4,957,256 | 9/1990 | Boeding | 40/642 X |
| 4,976,058 | 12/1990 | Valiulis | 40/657 |
| 5,109,992 | 5/1992 | Miller | 211/59.1 |
| 5,237,767 | 8/1993 | Kringel et al. | 40/642 |
| 5,421,113 | 6/1995 | Gebka et al. | 40/642 |
| 5,442,872 | 8/1995 | Moser | 40/642 |
| 5,511,332 | 4/1996 | Sturkie et al. | 40/642 |

FOREIGN PATENT DOCUMENTS

| | | | |
|---|---|---|---|
| 531034 | 3/1993 | European Pat. Off. | 40/657 |

*Primary Examiner*—Brian K. Green
*Assistant Examiner*—Andrea Chop
*Attorney, Agent, or Firm*—Michael Best & Friedrich LLP

[57] ABSTRACT

A product display for mounting to a support panel and supporting products. The product display includes a body comprised of two releasably engagable body members that are engagable in a nested relationship and releasable from the nested relationship. The product display also includes a pivotable panel that initially obstructs a consumer's view of how the products are supported by the product support and display and is also moveable to allow consumers to remove products from the product support and display. Product information or advertising indicia can be located on the body and the panel.

12 Claims, 3 Drawing Sheets

PRODUCT DISPLAY

FIELD OF THE INVENTION

The invention relates to a product support and display and, more particularly, to a display for use with a support.

BACKGROUND OF THE INVENTION

In some applications, products are displayed by a peg hook that is supported by a support panel commonly referred to as a pegboard. The support panel has various openings into which the peg hook can be placed so that the position of the peg hook can be changed easily to accommodate various arrangements of products on the support panel. Peg hooks typically have one end that is inserted into the support panel and an extension that supports the products to be displayed. The opposite end of the peg hook also typically includes a plate on which product indicia can be displayed.

Such product displays lack an aesthetically pleasing appearance and have limited space for product indicia.

SUMMARY OF THE INVENTION

The invention provides a display for use with a product support. Product supports include a support plate attached to a wire form support, or the like, including a plurality of elongated members at least two of which terminate in hook ends for receipt into openings in a support panel. The wire form support has, opposite to the hook ends, an end connected to the support plate. The product display includes a body including first and second releasably engagable body members. The first body member includes an aperture through which the elongated members of the support may extend. The first body member is positioned between the support plate and the hook ends. The second body member engages the first body member with the support plate positioned there between. A latch defines a releasable connection between the first and second body members. A panel is pivotally connected to the second body member. Products are supported by the wire form support and product information, graphics advertising and the like, is placed on the second body member and the panel.

It is an object of the present invention to provide an improved display which has universal applicability to any number of product support arrangements.

It is another object of the present invention to provide a product support and display for use with a wire form support and a support panel.

It is another object of the present invention to provide aesthetically pleasing product support and display for use with any wire form supports and support panel.

It is another object of the present invention to provide a product support and display that includes increased area for indicia such as product information, graphics, advertising and the like.

Other features and advantages of the invention will become apparent to those of ordinary skill in the art upon review of the following detailed description, claims, and drawings.

Figure 1:
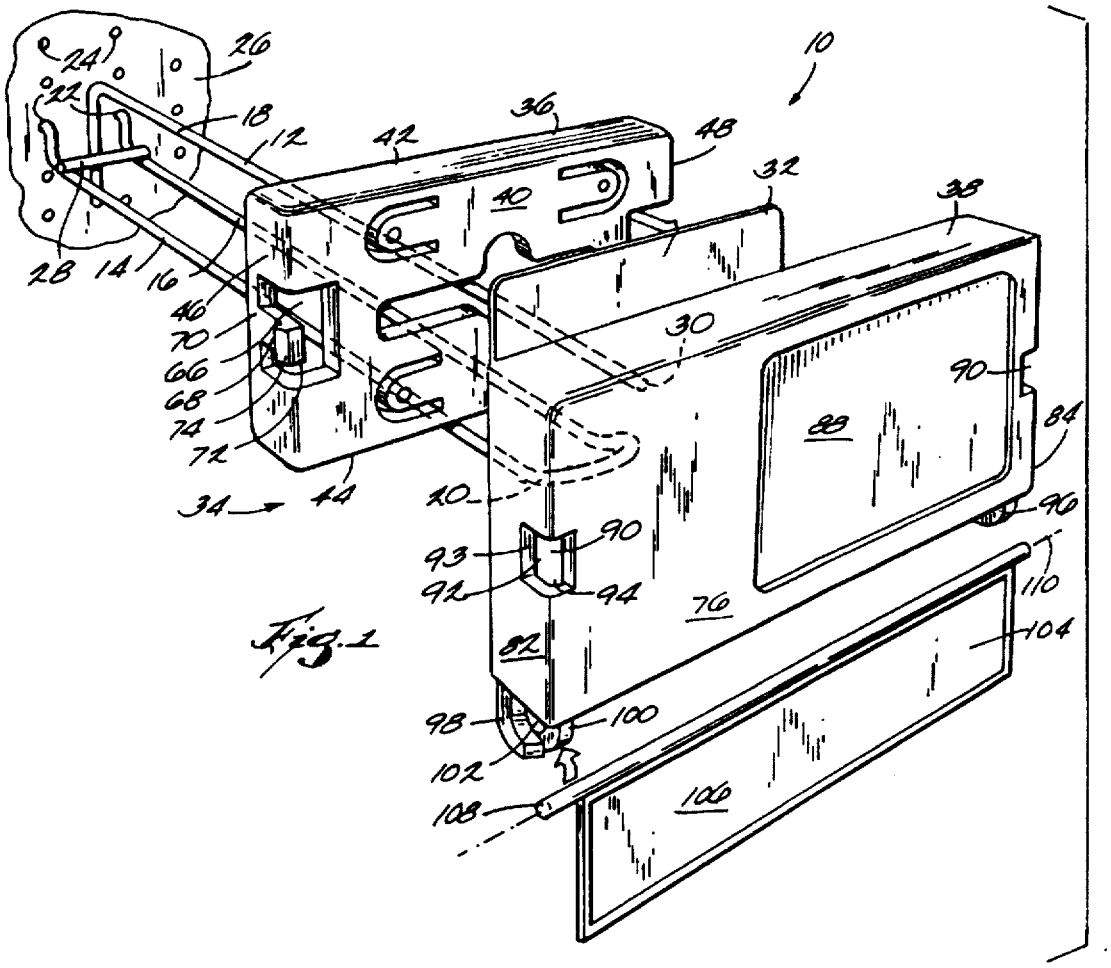
FIG. 1 is an exploded perspective view of the product support and display embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 2:
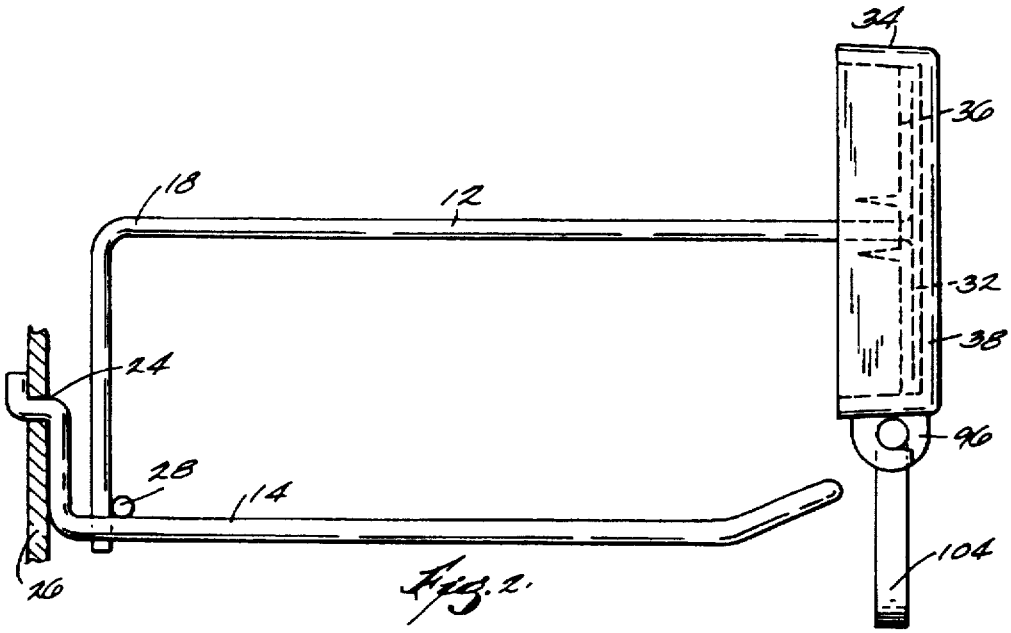
FIG. 2 is a side view of the product support and display.

Referring now to the drawings, there is shown in FIGS. 1 and 2 the product support and display 10 embodying the invention. The product support and display 10 is designed to be used with a wire form support such as peg hook 12. However, it should be noted that other types of wire form supports can be used in conjunction with the product support and display.

Figure 3:
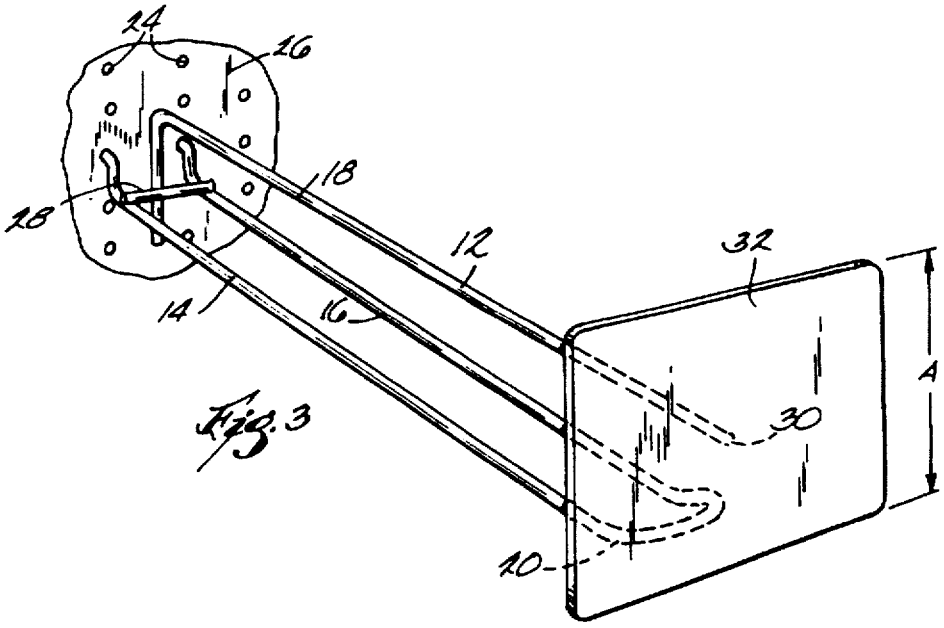
FIG. 3 is a perspective view of a pegboard with peg hook and plate.
Figure 5:
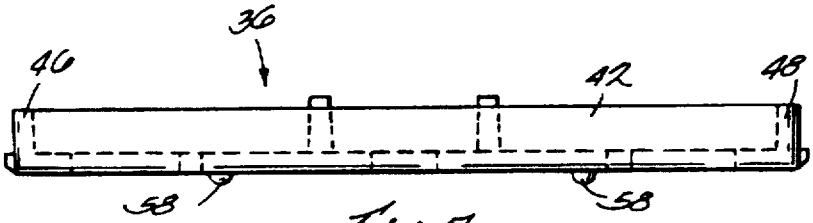
FIG. 5 is a top view of the rear body member.

Referring to FIG. 3, the peg hook 12 includes a plurality of elongated members 14, 16 and 18. The members 14 and 16 terminate on one end in a single looped end 20. Each member 14 and 16 terminates on its other end in a hook end 22. The hook ends 22 are conventional structurally and in being adapted to be inserted into openings 24 in a support panel such as pegboard 26. In the illustrated preferred embodiment, member 18 is L-shaped with the L-shaped portion adjacent the pegboard 26. The other end of the member 18 terminates in an end 30 that is secured to a support plate 32. It will be appreciated that these elements can be varied in both size and shape. The plate 32, in the illustrated embodiment, is generally rectangular having a height A. The plate 32 is secured to the end 30 of the member 18 in any suitable manner, such as by welding or the like depending upon material. The members 14 and 16, near the hook ends 22, and the member 18, in the L-shaped portion, are secured together by member 28 which can be secured in any means such as welding. In this orientation, the member 18 is most central and the members 14 and 16 are to the sides of and lower than the member 18.

Referring back to FIGS. 1 and 2, the product support and display 10 further includes a body 34 comprised of two releasably engagable body members 36 and 38. The body 34 is generally rectangular in shape. However, it should be noted that the body 34 could be of any shape such as circular, triangular and the like depending upon the aesthetics of the display.

Figure 4:
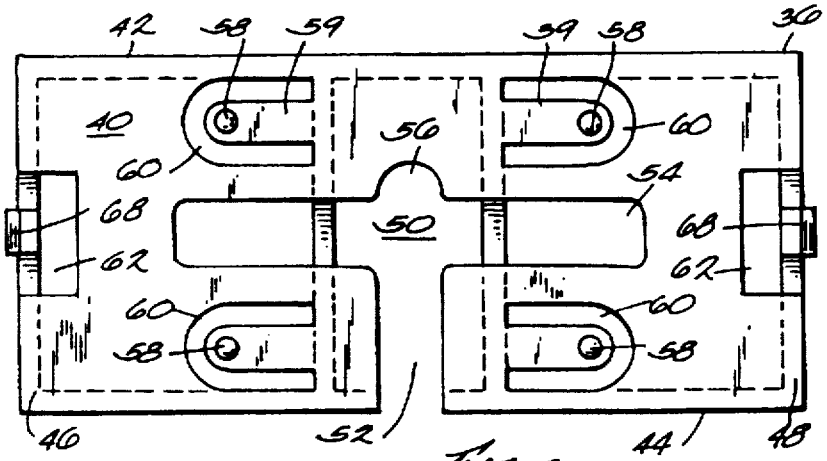
FIG. 4 is a front view of a rear body member of the product support and display.

Accordingly, as best shown in FIGS. 1 and 4, the first or rear body member 36 is generally rectangular having a front wall 40 and four side walls 42, 44, 46 and 48 that are integral with the front wall 40. The walls 42 and 44 are identical and comprise the top and bottom walls respectively of the rear body member 36. The walls 46 and 48 are identical and comprise the side walls of the rear body member 36. As shown in FIGS. 1, 5, 6 and 7, the walls 40, 42, 44, 46, and 48 cooperate to form the rear body member 36 that is generally U-shaped in cross-section.

Referring to FIG. 4, front wall 40 of the rear body member 36 includes a central generally T-shaped aperture 50 having a vertical slot 52, a horizontal slot 54 and a semicircular top portion 56. The rear body member 36 is configured to house the member 18 of the peg hook 12 in the aperture 50 as will be described in more detail.

The rear body member 36 also includes a plurality of discrete, semi-circular buttons 58, specifically four buttons 58 in the preferred embodiment supported on and extending laterally from ledges 59. Ledges 59 are formed by a plurality of U-shaped apertures 60, specifically four in the preferred embodiment. The combination apertures and ledges 59 provide a structure for engaging plates 22 of different thickness and maintaining a snug fit. That is, the ledges are capable of flexing to a limited degree and thereby provide a bias which maintains the buttons in engagement with the plate 32 regardless of the thickness of the plate.

Figure 7:
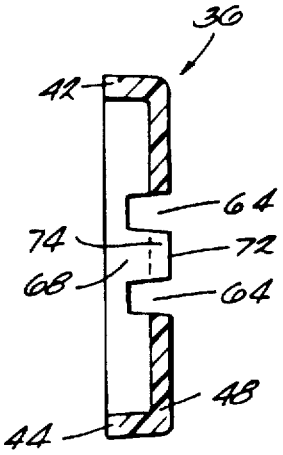
FIG. 7 is a sectional view of the rear body member.
Figure 6:
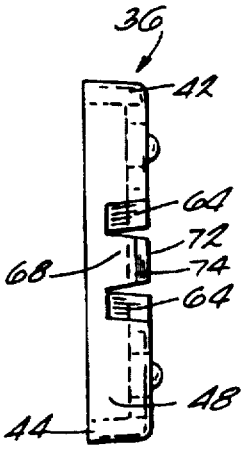
FIG. 6 is a side view of the rear body member.

The front wall 40 of the rear body member 36 has a pair of rectangular apertures 62 that are adjacent to the walls 46 and 48. As best shown in FIGS. 1, 6 and 7, each of the walls 46 and 48 have therein a pair of trapezoidal apertures 64 that communicate with the respective apertures 62 in the front wall 40. The aperture 62 and the aperture 64 on each side of the front wall 40 define a notch 66. In between the trapezoidal apertures 64, each side wall 46 and 48 includes a resilient hook arm 68. The hook arm 68 includes a first portion 70 that terminates in an end 72. The end 72 of the first portion 70 terminates in the same plane as the front wall 40. The hook arm 68 also has a hook tip portion 74. The resilient hook arm 68 has a normal position in which the hook tip portion 74 extends outwardly from the first portion 70 of the hook arm 68 in a direction away from the respective side wall 46 or 48 (FIG. 1).

Figure 8:
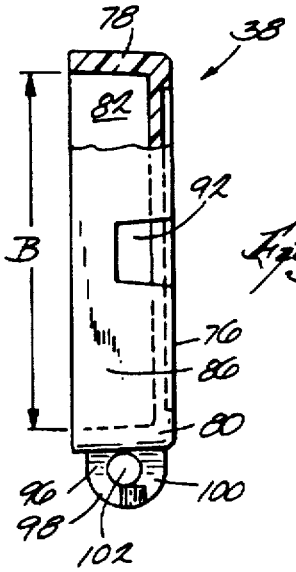
FIG. 8 is a side view of a front body member of the product support and display.

Referring to FIG. 1, the second or front body member 38 is generally rectangular having a front wall 76, and four walls 78, 80, 82 and 84 that are integral with the front wall 76. The walls 78 and 80 comprise the top and bottom walls respectively of the front body member 38. The walls 82 and 84 comprise the side walls of the front body member 36. As shown in FIG. 8, the walls 76, 78 and 80 cooperate to form the front body member 38 that is generally U-shaped in cross-section and which includes the rectangular recess 86. The recess 86 has a height B.

As illustrated in FIG. 1, the front wall 76 of the front body member 38 has thereon a recessed portion 88. The entire front wall 76 including the recessed portion 88 is adapted to received product information, graphics, advertising and the like. The front wall 76 has therein two rectangular apertures 90.

Referring now to FIGS. 1 and 8, each of the side walls 82 and 84 has therein a trapezoidal aperture 92 that is communication with the respective aperture 90 in the front wall 76. Each side wall 82 and 84 includes a surface 93 that defines one side of the aperture 92. The aperture 90 and aperture 92 on each side of the front wall 76 cooperate to define a notch 94 (FIG.1).

Figure 9:
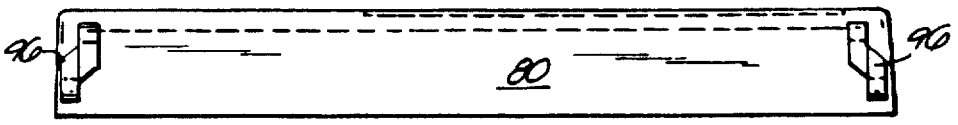
FIG. 9 is a bottom view of the front body member.

As illustrated in FIGS. 1, 8 and 9, the wall 80 of the front body member 38 has depending therefrom a pair of holders 96. Each holder 96 includes a pair of arcuate portions 98 and 100 that depend from the wall 80 with the arcuate portions 98 and 102 directed in opposite directions and so that a portion of each arcuate portion 98 and 100 abuts. In this orientation, the arcuate portions 98 and 100 cooperate to define a circular bore 102. This specific configuration is dictated for the most part by molding considerations.

As best shown in FIGS. 1 and 2, the product support and display 10 further includes a moveable door or panel 104. The panel 104 includes rectangular planar portion 106 that is designed to display product indicia such as information, graphics, advertising and the like. A cylindrical rod 108 is molded with the panel 104. The rod 108 has a length that is greater than the length of the panel 104 to provide projecting opposite ends and has a longitudinal axis 110.

In operation and with reference to FIGS. 1 and 2, the product support and display 10 is assembled and used as follows. The hook ends 22 of the peg hook 12 are inserted into the openings 24 of the pegboard 26 to support the peg hook 12 in a horizontal orientation. The rear body member 36 is positioned with respect to the peg hook 12 such that the member 18 is within the aperture 50 and such that the rear body member 36 is between the pegboard 26 and the plate 32. The front body member 38 is positioned in front of the plate 32 in a direction away from the pegboard 26 and aligned with the plate 32. The front body member 38 is moved such that the plate 32 is positioned in the recess 86 with the plate 32 abutting the rear of front wall 76. The plate 32 and the front body member are secured together, to a degree, by the height A of the plate 32 being approximately the same as or slightly smaller than the height B of the front body member 38.

The rear body member 36 is then moved into the recess 86 of the front body member 38. As the rear body member 36 is moved in the recess 86, the resilient hook arm 68 of each side wall 46 and 48 contacts and interferes with the respective side wall 82 and 84 of the front body member 38. Further forward movement of the rear body member 36 causes the hook arm 68 to deform inwardly from its normal position to a deformed position to allow the rear body member 36 to move further into the recess 86 of the front body member 38. At a point when the rear body member 36 is moved far enough into the recess 86, the hook tip portion 74 of the resilient hook arm 68 clears the respective side wall 82 and 84 and moves outwardly away from its respective side wall 46 or 48. In this position, the hook tip portion 74 abuts the surface 93 of each side wall 82 and 84 and protrudes from the notch 94 to latch the rear body member 36 within the recess 86 of the front body member. In this orientation, the member 18 is within the aperture 50 and the plate 32 is nested between front body member 38 and rear body member 36.

To release the rear body member 36 from the front body member 38, the hook tip portion 74 of each hook arm 68 is depressed inwardly to allow the hook tip portion 74 of each hook arm 68 to clear the surface 93 of its respective side wall 82 and 84. Thereafter, the rear body member 36 can be removed from the recess 86 of the front body member 38.

Accordingly, it is the hook arm 68 in conjunction with the side wall 82 or 84 of the front body member 38 and the notch 94 that defines a latch means for defining a releasable connection between the front and rear body members 38 and 36 respectively.

The panel 104 is positioned with respect to the front body member 38 as follows. One end of the rod 108 is positioned in the cylindrical bore 102 of one of the holders 96 such that the rectangular portion 106 abuts the respective holder 96. With a slight deformation of the panel 104, the other end of the rod 108 can be moved into the bore 102 of the other holder 96. In this orientation, the panel 104 is pivotally moveable along the axis 110. The holders 96 in conjunction with the rod 108 define means for pivotally connecting the panel 104 to the product support and display 10.

In use, products are loaded onto the members 14 and 16 by pivoting the panel 104 upwardly to expose the loop end 20 of the members 14 and 16. When loading of the products is completed, the panel 104 is allowed to hang downwardly to a normal position by the force of gravity.

Thereafter, when a customer is interested in a product supported and displayed by the product support and display 10, the customer can receive information about the product by reading such information on the front wall 76 of the front body member 38 and on the planar portion panel 106. If the customer desires to remove a product from the-product support and display 10, the panel 104 is pivoted upwardly and the customer can remove the product by forward movement of the product until it clears the loop end 20 of members 14 and 16. Thereafter, the customer releases the panel 104 and it returns to its normal position.

The pivotable panel 104 is designed such that upon first viewing of the products supported by the product support and display 10, the customer does not visually see how the products are supported. It is not until the panel 104 is pivoted upwardly that the customer can see how the products are supported.

The wire form support is preferably manufactured of wire. The plate 32 is preferably manufactured from a metal. The front and rear body members 36 and 36 are preferably manufactured from HIPS (High Impact Polystyrene). The panel 104 is preferably manufactured from medium impact styrene.

I claim:

1. A display for use with a support panel, a support plate, and a product support, the product support having a first end for engagement with the support panel and a second end connected to the support plate, said display comprising:

a body including first and second releasably engageable body members:

said first body member including an aperture and said product support adapted to extend through said aperture, said second body member adapted to be engageable with said first body member such that the support plate is positionable between said first and second body member, said second body member including a recess and said first body member being nestable in said recess to define a nested relationship, and a latch on said first and second body members defining a releasable connection between said first and second body members.

2. The product display of claim 1 wherein said latch comprises a mating latch and opening, said opening is defined by a plurality of walls, said mating latch having a normal position interfering with one of said walls defining said opening, said mating latch being movable away from said normal position to alternatively latch said first and second body members in said nested relationship and release said first and second body members for separation.

3. The product display of claim 2 including a plurality of discrete lateral projections on said first body member and projecting toward said second body member and adapted to be engageable with the support plate when said first and second members are in said nested relationship.

4. The product display of claim 3 wherein said first body member includes a plurality of generally U-shaped slots extending through said first body member, said slots defining ledges having a limited connection with said first body member, and said discrete lateral projections being positioned one on each of said ledges.

5. The product display of claim 2 wherein said first and second body members are generally rectangular, and further including a first notch provided on one side of said second body member and a second notch provided on an opposite side of said second body member, each of said notches including a planar surface, and a first hook arm provided on one side of said first body member and a second hook arm provided on an opposite side of said first body member, each hook arm having a normal position in interference with a respective one of said planar surfaces on said notches when said first and second body members are in said nested relationship and each hook arm movable away from its normal position to release said first and second body members for separation.

6. The product display of claim 3 including a planar panel pivotally connectable to said second body member.

7. A product display assembly for mounting to a support surface, said assembly comprising:

a product support;

a plate secured to said product support;

a body comprised of two releasably engageable body members that are engageable in a nested relationship and releasable from said nested relationship, and in said nested relationship said two releasably engageable body members having said plate positioned therebetween, a plurality of discrete lateral projections on one of said body members and projecting toward the other of said body members and engaging said plate when said body members are connected, and said one body member including a generally planar portion having a plurality of generally U-shaped slots extending therethrough, said slots defining ledges having a limited connection with said one body member, and said discrete lateral projections being positioned one on each of said ledges.

8. The product display assembly of claim 7 including a panel pivotally supported on and hanging below said body moveable to allow consumers to remove products from the product support.

9. A product display assembly comprising:

a support panel;

a plate;

a product support having a first end securable to said support panel and a second end securable to said plate;

said support panel including openings and wherein said first end of said product support is insertable into said openings, a body including first and second releasably engageable body members;

said first body member including an aperture and said product support extending through said aperture, said first body member positioned between said plate and said support panel;

said second body member engageable with said first body member such that said plate is positioned between said first and said second body members; and a latch on said first and second body members enabling a releasable connection between said first and second body members.

10. A product display assembly comprising:

a support panel;

a plate;

a wire form product support having a first end securable to said support panel and a second end securable to said plate;

a body including first and second releasably engageable body members;

said first body member including an aperture and said product support extending through said aperture, said first body member positioned between said plate and said support panel;

said second body member engageable with said first body member such that said plate is positioned between said first and said second body members: and a latch on said first and second body members enabling a releasable connection between said first and second body members.

11. A product display assembly comprising:

a support panel;

a plate;

a product support including a plurality of elongate members, said product support having a first end securable to said support panel and a second end securable to said plate;

a body including first and second releasably engageable body members;

said first body member including an aperture and said product support extending through said aperture, said first body member positioned between said plate and said support panel;

said second body member engageable with said first body member such that said plate is positioned between said first and said second body members; and a latch on said first and second body members enabling a releasable connection between said first and second body members.

12. A product display as set forth in claim 11 wherein said elongate members includes first, second and third elongate members, wherein said first and second elongate members terminate at a first end in hook ends which define said second end of said product support and terminate in a second looped end, and wherein said third elongate member terminates in an end that defines said first end of said product support.

* * * * *

UNITED STATES PATENT AND TRADEMARK OFFICE

CERTIFICATE OF CORRECTION

PATENT NO. : 5,775,017

DATED : July 7, 1998

INVENTOR(S) : Lester W. Morrow

It is certified that error appears in the above-indentified patent and that said Letters Patent is hereby corrected as shown below:

Claim 6, column 6, line 16, "3" should be --2--.

Signed and Sealed this

Twenty-fourth Day of November, 1998

Bruce Lehman

*Attest:*

BRUCE LEHMAN

*Attesting Officer*

*Commissioner of Patents and Trademarks*